US008430038B2

(12) United States Patent
Fichtner et al.

(10) Patent No.: US 8,430,038 B2
(45) **Date of Patent: *Apr. 30, 2013**

(54) LINE-CHANGING DEVICE FOR MAGNETIC LEVITATION TRAINS AND KIT FOR ITS MANUFACTURE

(75) Inventors: Karl Fichtner, Munich (DE); Robert Lippert, Hofgeismar (DE); Franz-Xaver Pichlmeier, Taufkirchen (DE)

(73) Assignee: ThyssenKrupp Transrapid GmbH, Kassel (DE)

( * ) Notice: Subject to any disclaimer, the term of this patent is extended or adjusted under 35 U.S.C. 154(b) by 12 days.

This patent is subject to a terminal disclaimer.

(21) Appl. No.: 12/098,160

(22) Filed: Apr. 4, 2008

(65) Prior Publication Data

US 2008/0258017 A1 Oct. 23, 2008

(30) Foreign Application Priority Data

Apr. 23, 2007 (DE) ..... 10 2007 019 525

(51) Int. Cl.
*B61B 13/08* (2006.01)

(52) U.S. Cl.
USPC ..... 104/130.03; 104/130.02

(58) Field of Classification Search ..... 104/130.01–130.06, 130.11, 48
See application file for complete search history.

(56) References Cited

U.S. PATENT DOCUMENTS

| | | | | |
|---|---|---|---|---|
| 3,556,011 | A * | 1/1971 | Saxonmeyer | 104/48 |
| 4,870,906 | A | 10/1989 | Schaffer et al. | |
| 6,739,267 | B2 * | 5/2004 | Fichtner et al. | 104/130.11 |
| 2009/0013898 | A1 * | 1/2009 | Zheng et al. | 104/130.01 |

FOREIGN PATENT DOCUMENTS

| | | |
|---|---|---|
| AT | 210920 | 9/1960 |
| DE | 1 036 890 | 8/1958 |
| DE | 37 09 619 | 10/1988 |
| DE | 40 38 339 | 6/1992 |
| DE | 10 2004 015 495 | 10/2005 |
| DE | 10 2005 057 554 | 5/2007 |
| DE | 10 2006 003 678 | 8/2007 |

OTHER PUBLICATIONS

Gert SCHVV1NDT Und Peter-Juergen Gaede "Die Schnellfahrweiche." (With English Abstract).

* cited by examiner

*Primary Examiner* — S. Joseph Morano
*Assistant Examiner* — Zachary Kuhfuss
(74) *Attorney, Agent, or Firm* — Michael J. Striker

(57) ABSTRACT

A line-changing device for magnetic levitation trains includes a rail section, at least one rail positioned transversely thereto, and a support frame for the rail section, which includes at least two wheels supported on the rail. The support frame includes a support module connected with the rail section, and two wheel modules attached to the sides thereof in a replaceable manner, and in which at least one of the wheels is rotatably supported.

16 Claims, 15 Drawing Sheets

LINE-CHANGING DEVICE FOR MAGNETIC LEVITATION TRAINS AND KIT FOR ITS MANUFACTURE

CROSS-REFERENCE TO A RELATED APPLICATION

The invention described and claimed hereinbelow is also described in German Patent Application DE 10 2007 019 525.9 filed on Apr. 23, 2007. This German Patent Application, whose subject matter is incorporated here by reference, provides the basis for a claim of priority of invention under 35 U.S.C. 119(a)-(d).

BACKGROUND OF THE INVENTION

The present invention relates to a line-changing device, and to a kit for its manufacture.

A known line-changing device of the type of interest here is composed of a [*Transrapid Mag-Lev Train—The New Dimension of Travel*], Hestra-Verlag Darmstadt 1989, pages 32 through 35, DE 10 2004 015 495 A1). An essential component of a bending point of this type is a flexible, steel support, which is, e.g., 80 m or even longer or shorter, which carries the rail or equipment associated therewith. The support is positioned in a stationary manner at one end, while the rest of the carrier is supported using a plurality of support frames and wheels mounted thereon such that it may be moved along rails located transversely to its longitudinal direction, which is also the direction of travel. To adjust the switch, the support frames may be moved back-and-forth along the rails, thereby bending the support in an elastic manner and aligning it with any of several routes that branch off from the switch.

Numerous parts that are subject to wear are accommodated in the support frames, which are also referred to as rail cross-members. The parts subject to wear are wheels, bearing bushes, gears, transmissions, couplings, motors, or the like, and they serve to facilitate a line change. To fulfill the requirements placed on the repair/maintenance and, therefore, on the availability of line-changing devices, the parts subject to wear—at the least—must be replaced from time to time. To ensure that this would result only in a brief interruption of the magnetic levitation train, which operates 24 hours a day, a further requirement is that it be possible to replace the parts subject to wear in the shortest amount of time possible, e.g., within a few hours. When the known line-changing devices are used, difficulties arise, however, because the support frames must be removed entirely and replaced with new support frames, a task which is made that much more difficult at high elevations above the ground and in places that are difficult to access, due to the relatively heavy weight of the support frame.

SUMMARY OF THE INVENTION

The technical problem of the present invention, therefore, is to design the line-changing device of the general class described initially such that installation and maintenance work may be performed more easily and quickly than in the past.

In keeping with these objects and with others which will become apparent hereinafter, one feature of the present invention resides, briefly stated, in a line-changing device for magnetic levitation trains, comprising a rail section; at least one rail located transversely to said rail section; a support frame for said rail section, which includes at least two wheels supported on said rail, said support frame including a support module connected with said rail section, and two wheel modules attached to a side thereof in replaceable manner, in which at least one of said wheels is rotatably supported.

The present invention provides the advantage that the support frame is no longer designed as a single piece, but rather is composed of three parts, i.e., a center support module, which is fixedly connected with the rail section to be bent, swiveled, or displaced, and two wheel modules that include the wheels, which are attached to the support module in an easily detachable manner.

To perform repair and maintenance work, it is therefore usually sufficient to only replace the wheel modules—which is a task that may be carried out quickly using relatively simple auxiliary means, due to their light weight—while the support module remains attached to the rail section.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 12 is a swivel platform, and FIG. 13 is a transfer table.

DESCRIPTION OF THE PREFERRED EMBODIMENTS

Figure 1:
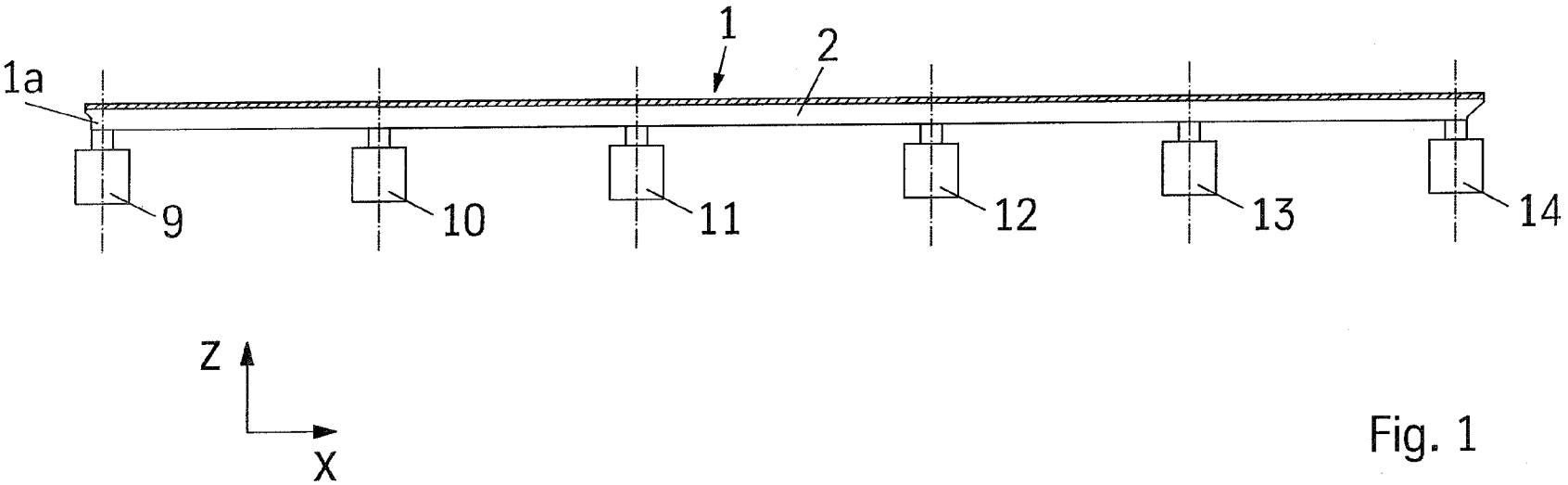
FIGS. 1 and 2 are a schematic side view and a top view of a line-changing device designed for use with magnetic levitation trains, with a bending mount.

According to FIGS. 1 through 6, a typical line-changing device designed as a bending point for magnetic levitation trains includes a flexible, steel rail section or support 1, which extends along the entire length of the switch, and which is, e.g., approximately 80 m long, or longer or shorter. Rail section 1 includes a support element 2, which extends in a longitudinal direction (=x direction), and which is preferably composed of a box profile body, e.g., a hollow profile body with a rectangular cross section with a greater height than width.

Figure 4:
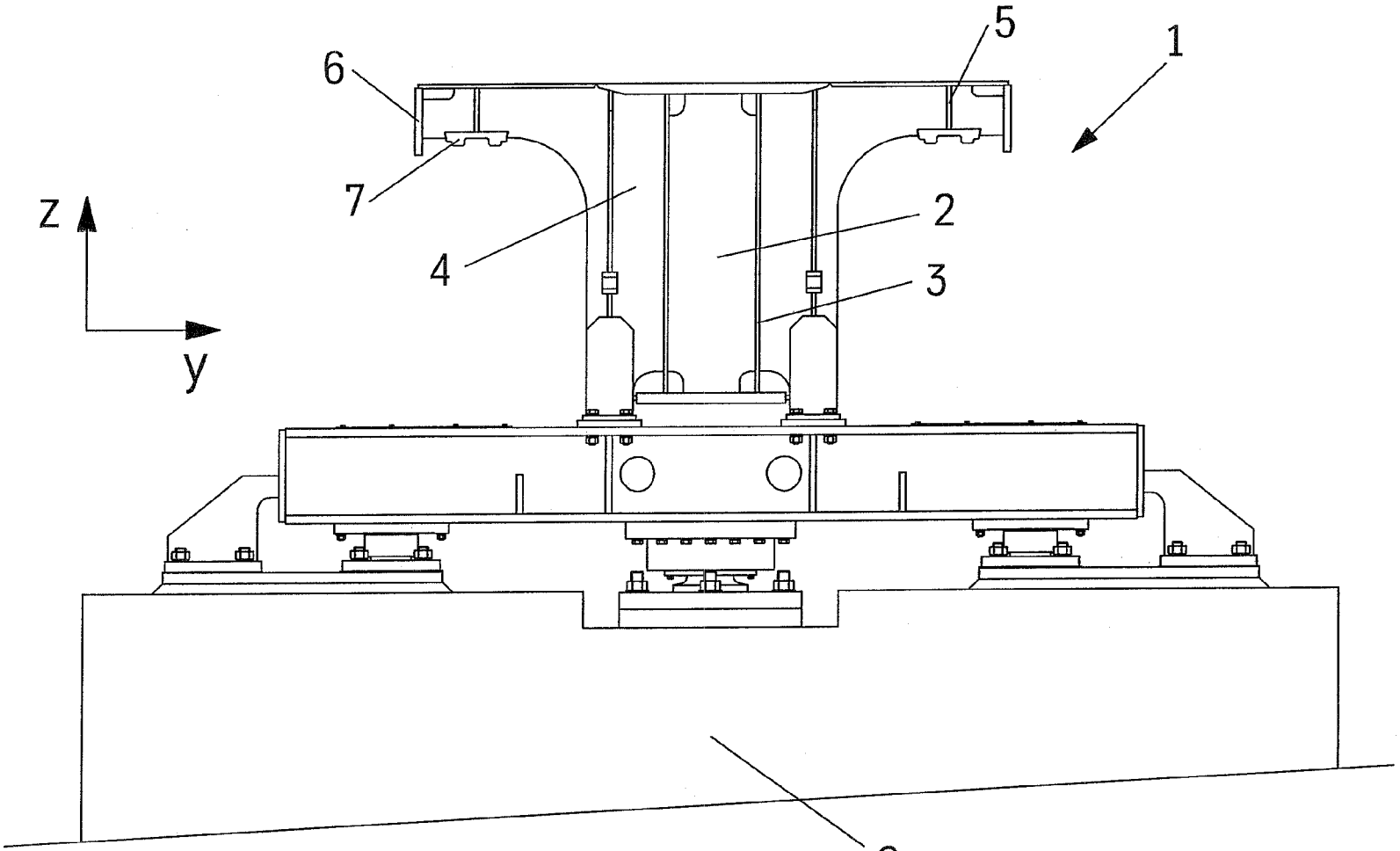
FIGS. 4 and 5 are schematic cross sections along lines IV-IV and V-V in FIG. 3, rotated by 90°.
Figure 5:
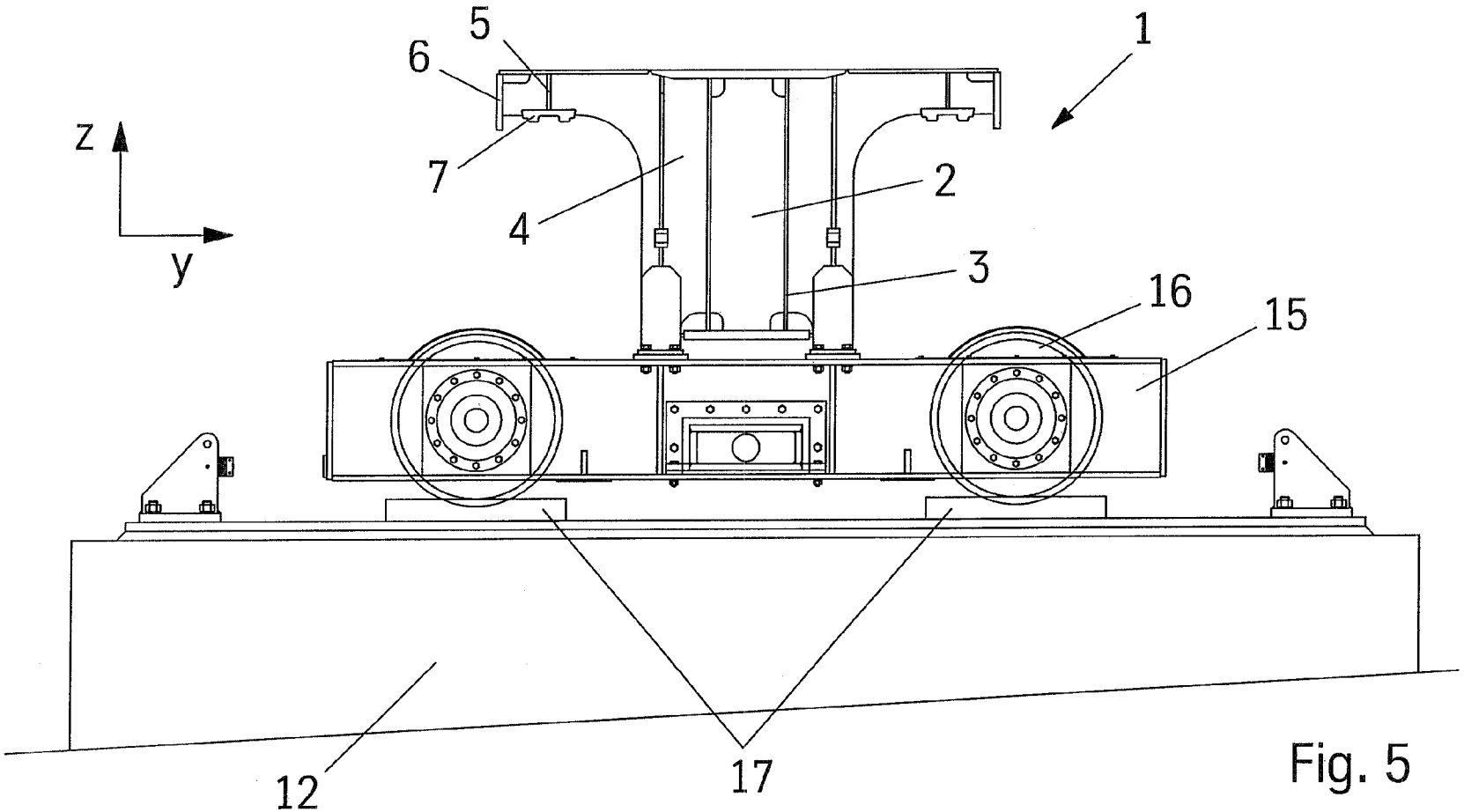

As shown in FIGS. 4 and 5 in particular, support element 2 includes two web plates and/or side parts 3 which, in the installed state, are positioned essentially vertically and perpendicularly to the ground. Cantilevers and/or gusset plates 4 are attached to each side part 3 and extend perpendicularly therefrom, on the ends of which ribs 5 are attached. In general, the direction of travel of the vehicles along rail section 1 and its longitudinal axis is referred to as the x-axis of an imagined coordinated system, while the transverse direction (width), in which gusset plates 4 extend, are referred to as the y-axis. The direction perpendicular to these two axes (the height) is referred to as the z-axis of the imagined coordinate system.

Equipment parts 6 designed as lateral guide rails, which serve to keep the vehicles on track and which are positioned vertically in the installed state, are installed on ribs 5. In the exemplary embodiment, a lateral guide rail is provided on either longitudinal side of rail section 1.

Two further equipment parts designed as not-shown gliding strips are mounted on the top side of rail section 1. Gliding strips serve to set the vehicles down. Gliding strips extend, as do equipment parts 6, along the entire length of rail section 1. In contrast, they are oriented essentially horizontally in the installed state. Finally, rail section 1 is provided with equipment parts 7 designed as stator carriers on the underside of ribs 5. Equipment parts 7 are used, e.g., to attach the stator cores of an elongated stator-linear motor.

The parts described are composed of steel and are non-detachably connected with each other, preferably via welding, to form rail section 1 shown in FIGS. 1 through 6.

Figure 2:
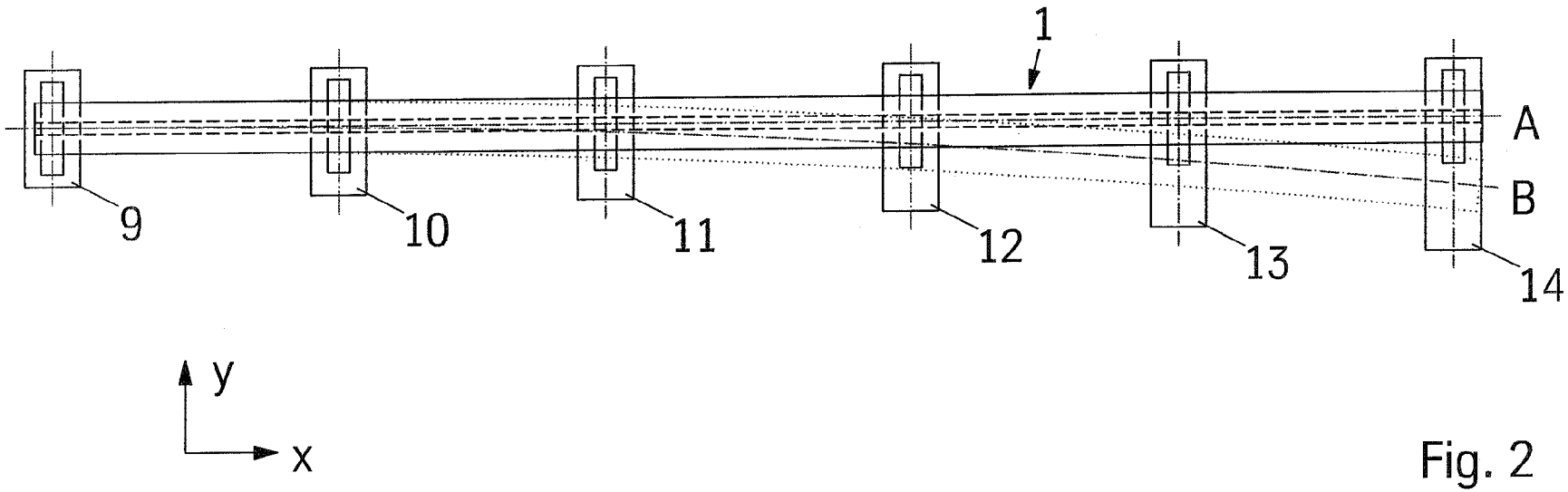

As shown in FIG. 2, rail section 1 is bent continually by a maximum of, e.g., approximately 3.65 m to adjust the line-changing device, e.g., from a continuous route A to a branch-off route B. To this end, rail section 1 is supported, e.g., on six supports 9 through 14, which are anchored in the ground. One end 1*a* (e.g., FIGS. 1 and 6) of rail section 1 is fixedly connected in a not-shown manner with a first support—support 9 in this case—while other sections of rail section 1 may be moved back=and-forth on the other supports 10 through 14, e.g., support 12 as shown in FIGS. 3 and 5, transversely to the longitudinal direction and essentially horizontally.

This is accomplished using a support frame 15 (FIGS. 3 and 5) in the region of each support 9 through 14, support frame 15 being installed on the underside of rail section 1, thereby supporting it. Support frame 15 is installed such that it is displaceable on rails 17 using wheels 16. The weight of rail section 1 is therefore carried by wheels 16 and rails 17.

Figure 7:
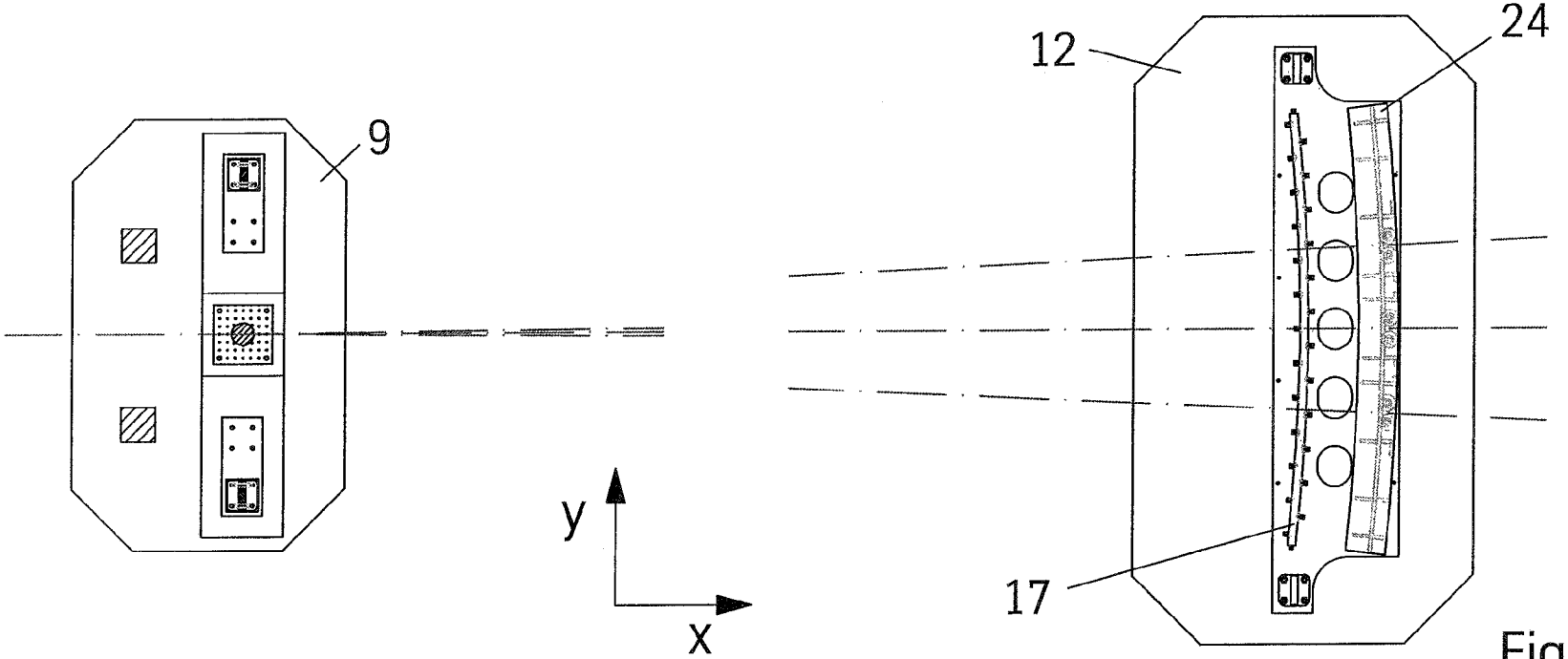
FIG. 7 is a schematic top view of two supports of the line-changing device in FIG. 6, without one rail section and its support frames.

As shown, e.g, in a top view in FIG. 7 without rail section 1 and support frame 15, rails 17 are located on particular supports 10 through 14, essentially transversely to rail section 1, i.e., they extend in the y-direction and are slightly curved in design. Particular curvature of rails 17 is defined in accordance with the bending curves formed in rail section 1, i.e., it is dimensioned essentially in accordance with the trajectories along which the parts—which are supported on associated support frames—of rail section 1 move when rail section 1 is bent in the y-direction by moving particular support frame while holding end 1*a* fixed. These trajectories are approximately circular trajectories.

Figure 3:
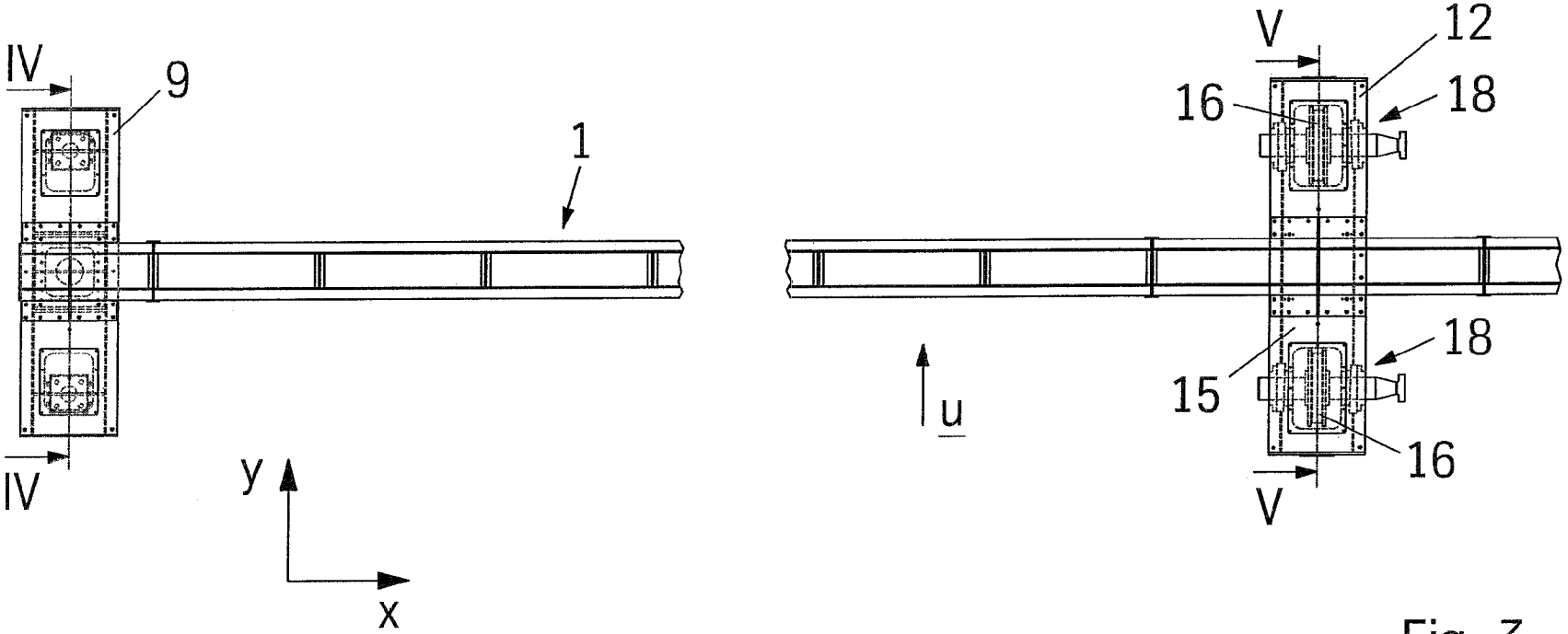
FIG. 3 is a schematic top view of the line-changing device in FIG. 2, with additional detail.
Figure 6:
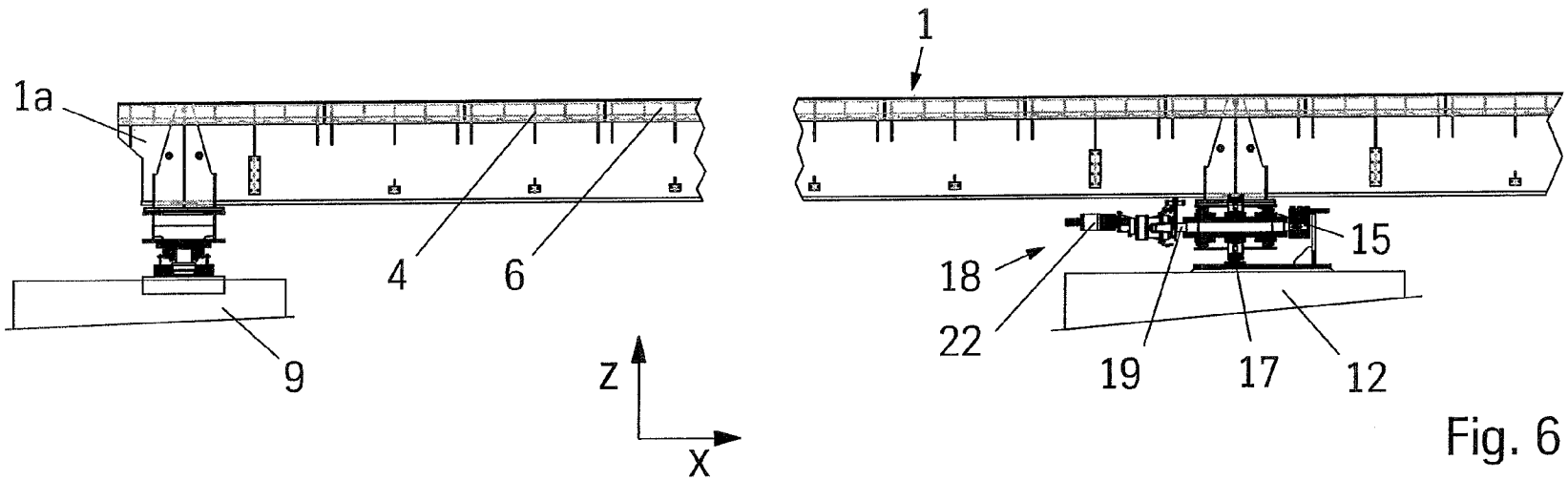
FIG. 6 is a schematic side view of the line-changing device in the direction of arrow u in FIG. 3.
Figure 8:
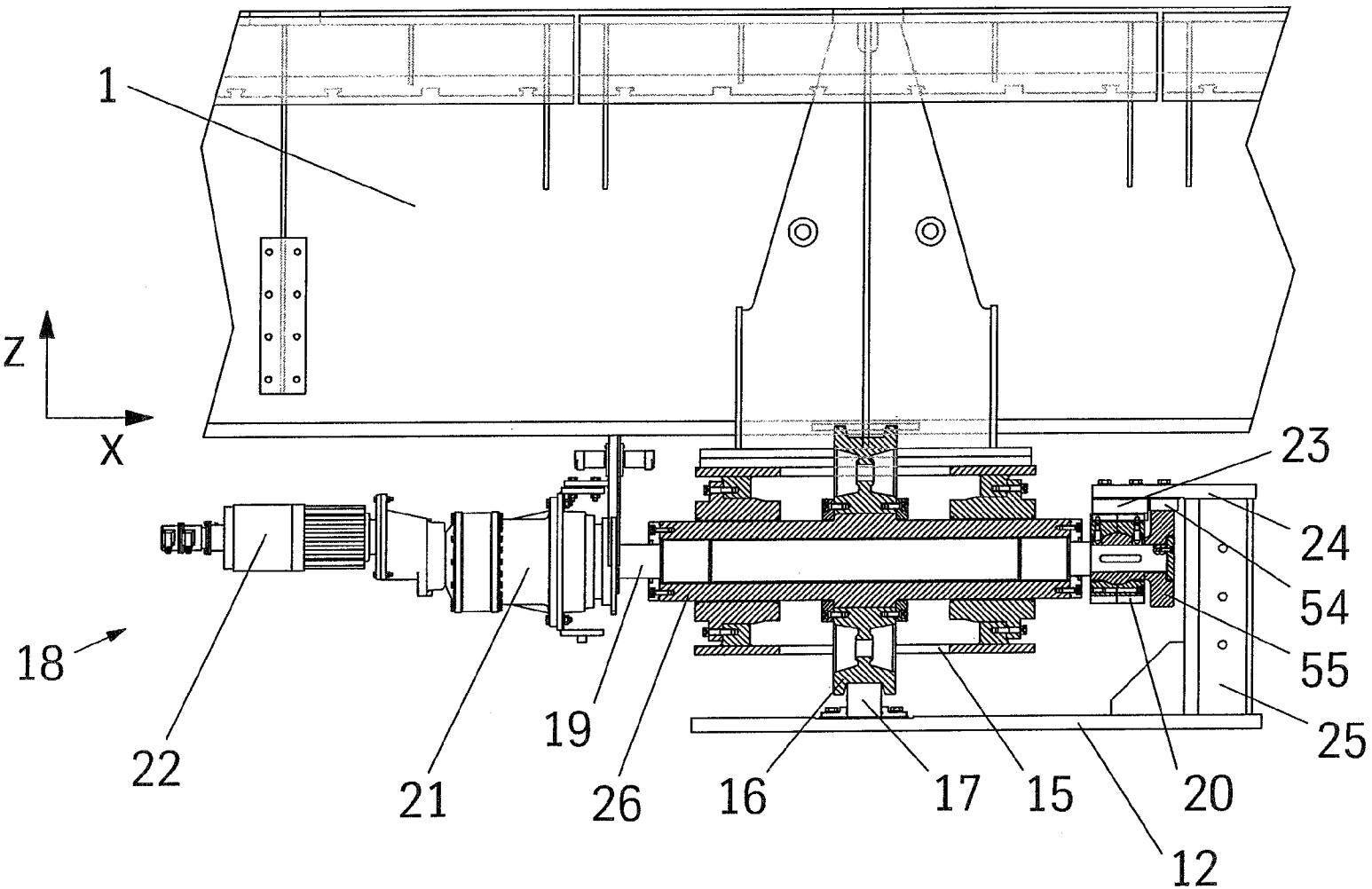
FIG. 8 is a greatly enlarged longitudinal sectional view through the support frame in FIG. 6 and a drive mechanism of the line-changing device.

A drive mechanism 18 shown in FIGS. 3, 6 and 8 and which is connected with support frame 15 is used to displace selected support frame 15 in the y-direction. As shown in FIG. 8 in particular, drive mechanism 18 includes at least one drive shaft 19, which extends nearly parallel to the direction of travel, i.e., the longitudinal direction. Drive shaft 19 is fixedly connected at one end with a gear 20, and, at the other end, it is fixedly connected via a coupling and a transmission 21 with the drive shaft of a motor 22. Gears 20 of various drive mechanisms 18 are each engaged with a rack 23 (FIG. 8), which is positioned transversely to the direction of travel and essentially parallel with particular rail 17 (FIG. 7).

Racks 23 are attached to the undersides of holding plates 24 (FIGS. 7 and 8) installed on a stator 25, which is mounted on particular support (e.g., 12), which supports it. When motors 22 are therefore switched on and drive shafts 19 are set into rotation in one direction of rotation or the other, gears 20 roll on their assigned racks 23, thereby moving associated support frame 15 and, therewith, the parts of rail section 1 resting thereon, in the y-direction. Rail section 1 is therefore bent in the manner illustrated in FIG. 2 and it is oriented toward along one of at least two routes A or B.

As shown in FIG. 8, support frame 18 includes at least one hollow shaft 26 with a central axis, which extends in parallel with the x-axis. Hollow shaft 26 extends coaxially through a hub of wheel 16 and is connected with this hub in a non-rotatable manner, and fixedly in the axial and radial directions, thereby preventing relative motions between wheel 16 and hollow shaft 26. Hollow shaft 26 is rotatably supported in support frame 15 and serves to rotatably support drive shaft 19 extending through it. The required bearings are not shown.

As shown in FIG. 2, at least one support frame 15, which is displaceable transversely to the direction of travel in the manner described, is required to adjust the line-changing device. In reality, however, a plurality of support frames 15 of this type is usually provided, depending on the length of rail section 1. All of these support frames 15 and the units required to displace them may have essentially the same design. In addition, as shown in FIG. 3, for example, identical drive mechanisms 18 are provided on either side of rail section 1 in the exemplary embodiment, each of which drives a wheel 16 of particular support frame 15. These two drive mechanisms 18 also have essentially the same design. Depending on the forces to be applied, it may suffice to provide only one drive mechanism on a few support frames 15, or to design selected support frames 15 without a drive mechanism 18.

Motor 22 is connected with rail section 1 or with an assembly part connected therewith via a not-shown support (a torque multiplier) in an axially non-displaceable and non-rotatable manner. As a result, motor 22 is prevented from rotating around the central axis, and axial relative motions between the motor and rail section 1 are prevented.

The method of operation of the configuration described in FIG. 8 is essentially as follows.

The line-changing device is displaced by switching on motor 22, in order to start drive shaft 19 rotating in the desired direction of rotation. As a result, gear 20 rolls on rack 23 in the y-direction, while drive shaft 19, hollow shaft 26 coupled with it, and wheel 16 mounted on hollow shaft 26 make the same motion. The result is that wheel 16 rolls on rail 17 and rail section 1 bends. The different rotational speeds and directions of gear 20 and wheel 16 that result are made possible via relative rotations between shafts 19 and 26, e.g., using not-shown sliding bearings. As hollow shaft 26 moves in the y-direction, so does rail section 1 mounted thereon. The same applies for all of the support frames 15, which are actuated essentially simultaneously. The line-changing device is therefore adjusted in the manner described above with reference to FIG. 2. When the new track setting has been attained, it is locked in place using not-shown means, which are known per se.

Line-changing devices of this type are known to one skilled in the art from prior use, so they will not be described in greater detail. A line-changing device of this type is also described in the older, unpublished German patent application DE 10 2006 003 678.6, which is hereby made an object of the present disclosure, to avoid referencing it repeatedly.

Figure 9:
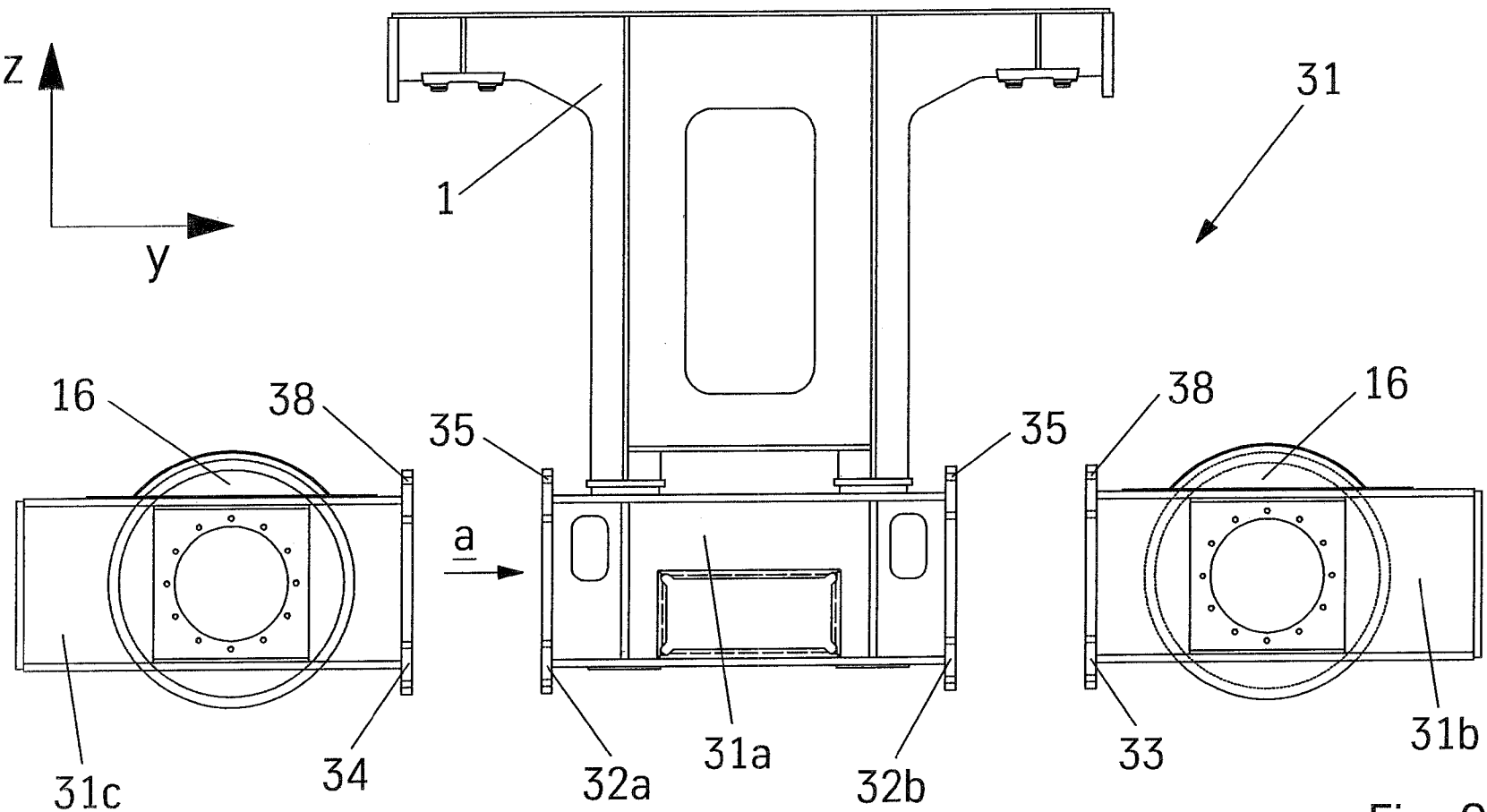
FIG. 9 is a cross section through a support frame of an inventive line-changing device.
Figure 10:
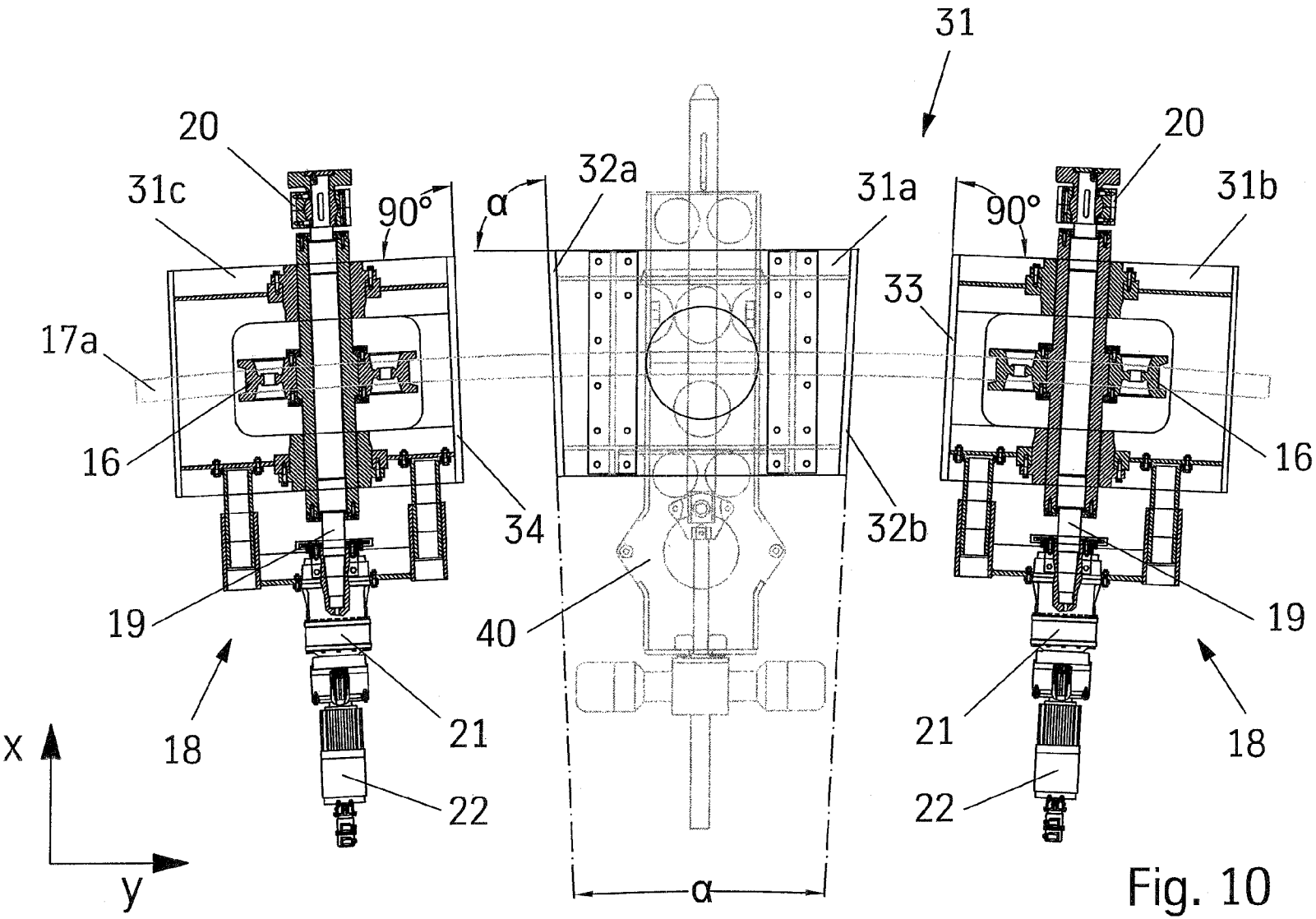
FIG. 10 is a partially cut-away top view of the support frame in FIG. 9, but without the rail section mounted thereon.

When the line-changing device described is used, if repair or maintenance is required, the entire support frame 15—which has been manufactured as a single piece—must be removed and replaced with a new support frame 15, including all of the associated parts. To prevent this, the present invention as shown in FIGS. 9 and 10 provides a support frame 31 composed of parts positioned next to each other in the y-direction, i.e., a center support module 31*a*, a wheel module 31*b* shown on the right in FIG. 9, and a wheel module 31*c* shown on the left in FIG. 9.

Support module 31*a* is installed on the underside of rail section 1 in a not-shown manner. Support module 31*a* is provided with a top plate 32*a*, 32*b* on each of its sides facing wheel modules 31*b*, 31*c*.

One of the wheels 16 is rotatably supported on or in wheel module 31*b*. If it is a driven wheel 16, drive mechanism 18 shown in FIG. 8 is also installed on or in wheel module 31*b*. Wheel module 31*b* shown in FIG. 9 also includes an assembly plate 33 on its left side, which faces support module 31*a*. Wheel module 31*c* is designed accordingly, but preferably with mirror symmetry with wheel module 31*b*, and is therefore provided with an assembly plate 34 on its side shown on the right in FIG. 9.

Figure 11:
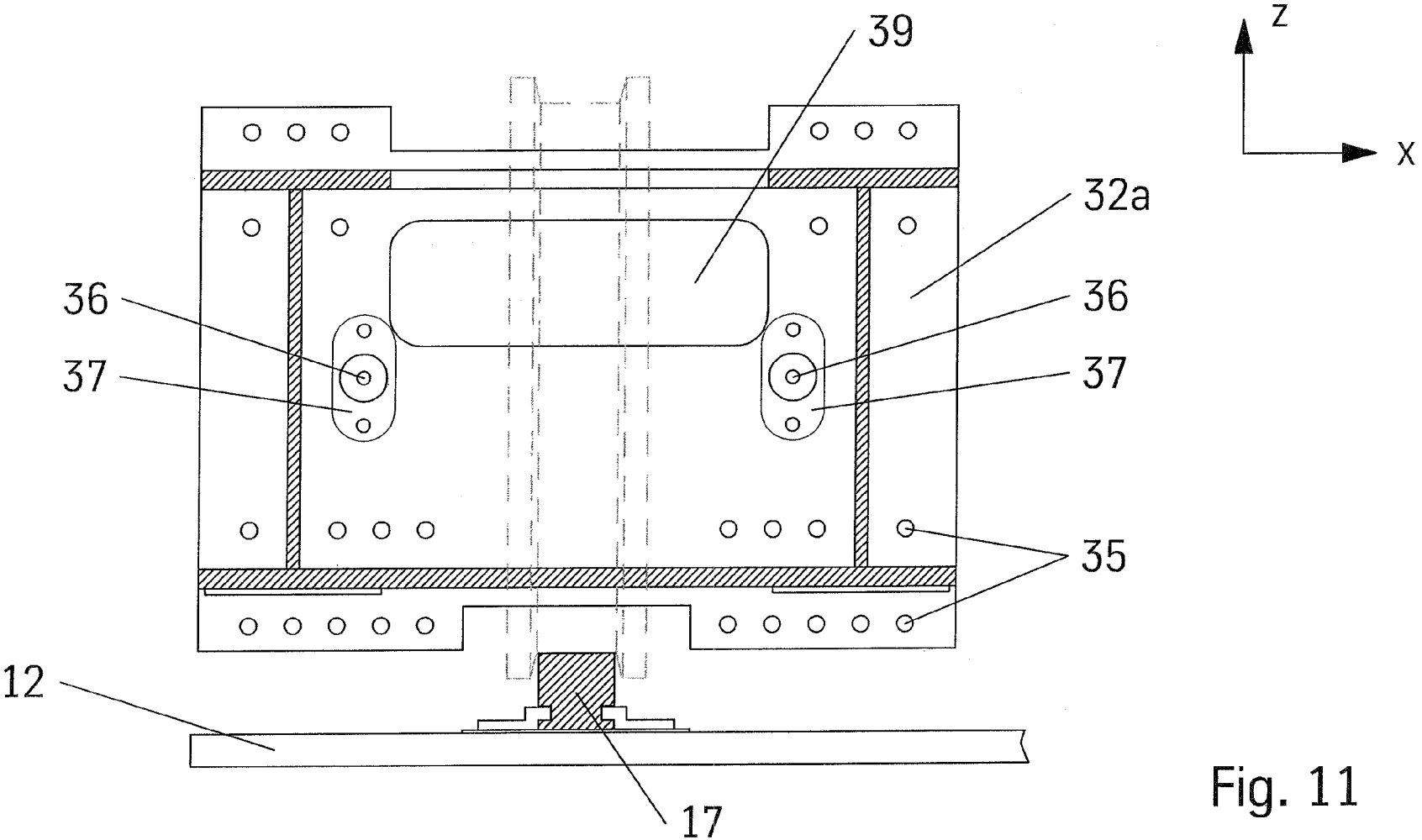
FIG. 11 is a view of a top plate in the direction of an arrow a in FIG. 9.

As shown in FIG. 11, top plate 32*a* includes a plurality of screw holes 35 and, e.g., two raised, projecting positioning means, e.g., positioning bolts 36, that are attached to holders 37 and are installed with them on top plate 32*a*. Top plate 32*b* is preferably designed exactly as top plate 32*a*, but with mirror symmetry therewith.

Assembly plates 33, 34 include a plurality of screw holes 38 (FIG. 9) having the same hole pattern as top plates 32*a*, 32*b* assigned to them, and they include not-shown positioning means, e.g., positioning holes, which are designed to receive positioning bolts 36. Of course, any other similar positioning means may be provided other than those described.

To install wheel modules 31*b*, 31*c* on support module 31*a*, assembly plate 33 is first placed against top plate 32*b* and assembly plate 34 is placed against top plate 32*a* such that stop surfaces provided on them come in contact with each other, and positioning bolts 36 (FIG. 11) enter associated positioning holes in assembly plates 33, 34. The relative position of the three modules 31*a*, 31*b* and 31*c* is therefore ensured, and screw holes 35, 38 are oriented coaxially with each other. Next, not-shown fastening screws are inserted in screw holes 35, 38, and bolts are screwed onto them from the other side, the installation of which may be simplified, e.g., via recesses 39 (FIG. 11) in top plates 32*a*, 32*b* and assembly plates 33, 34. In all, the design ensures that rail section 1 mounted on support module 31*a* does not hinder the installation or removal of wheel modules 31*b*, 31*c*.

After modules 31*a*, 31*b* and 31*c* are assembled in the manner described, resultant support frame 31 advantageously has essentially the same outer contour and the same design as the known support frame (FIGS. 3 through 8). As shown in FIG. 10 in particular, wheels 16, drive mechanisms 18, and all of the other drives parts that 15 are subject to wear, such as bearings, gears 20, transmission 21, motors 22, etc., are accommodated in one of the wheel modules 31*b*, 31*c*.

The support module 31*a* essentially serves only to support rail section 1, it includes no drive parts subject to wear, and may accommodate a typical locking mechanism 40 (FIG. 10) if necessary, which serves to lock in the positions of rail section 1 attained with drive mechanisms 18, and which may be maintained and repaired, if necessary, without removing support module 31*a*. If the drive parts subject to wear must be replaced, this can be easily accomplished by removing wheel module 31*b* and/or 31*c* by loosening the fastening screws from support module 31*a*, removing them, and replacing them/it with a new, ready-to-use replacement module. If desired or required, this work may be simplified by raising support module 31*a* slightly during this work, using a press or the like positioned underneath.

According to a particularly preferred exemplary embodiment of the present invention that is so far considered to be the best, all wheel modules 31*b*, 31*c* of one line-changing device as shown in FIG. 2 are identical, e.g., the rotation axes of all wheels 16 have exactly the same position relative to assembly plate 33 or 34 involved. On the other hand, individual adjustments may be made to a single line-changing device by specifying the relative position of top plates 32*a*, 32*b* in support modules 31*a* accordingly.

With the design shown in FIG. 10, the bending of bending mount or rail section 1 associated with, e.g., support 12 in FIG. 2, requires that rail 17 associated with wheels 16 curves, as indicated in FIG. 10 with reference numeral 17*a*. As a result, top plates 32*a*, 32*b* are located on support module 31*a* such that they are positioned essentially perpendicularly to rail 17 (or 17*a*) in any position of support frame 31. Top plates 32*a*, 32*b* are therefore not located parallel with each other, but rather at an inclination angle $\alpha$ (FIG. 10) relative to each other, inclination angle $\alpha$ being adapted to the arc segment of rail 17 located between the two top plates 32*a*, 32*b*. If assembly plates 33, 34 of wheel modules 31*b*, 31*c* are therefore attached to associated top plates 32*a*, 32*b*, the rotation axes of wheels 16 automatically assume the correct position relative to rail 17 (or 17*a*) shown in FIG. 10.

The same applies, in general, for the other supports 11 through 14 shown in FIG. 2. Since rails 17 assigned to the supports have other curvatures, inclination angle $\alpha$ (FIG. 10) between top plates 32*a*, 32*b* of associated support modules 31*a* is modified accordingly. In these cases as well, wheels 16 automatically assume the correct position relative to rail 17 after wheel modules 31*b*, 31*c* are installed on support modules 31*a*. Considerable advantages therefore result, not only in terms of replacing worn parts, but also in terms of manufacturing modules 31*a* through 31*c* in a cost-favorable manner.

Figure 12:
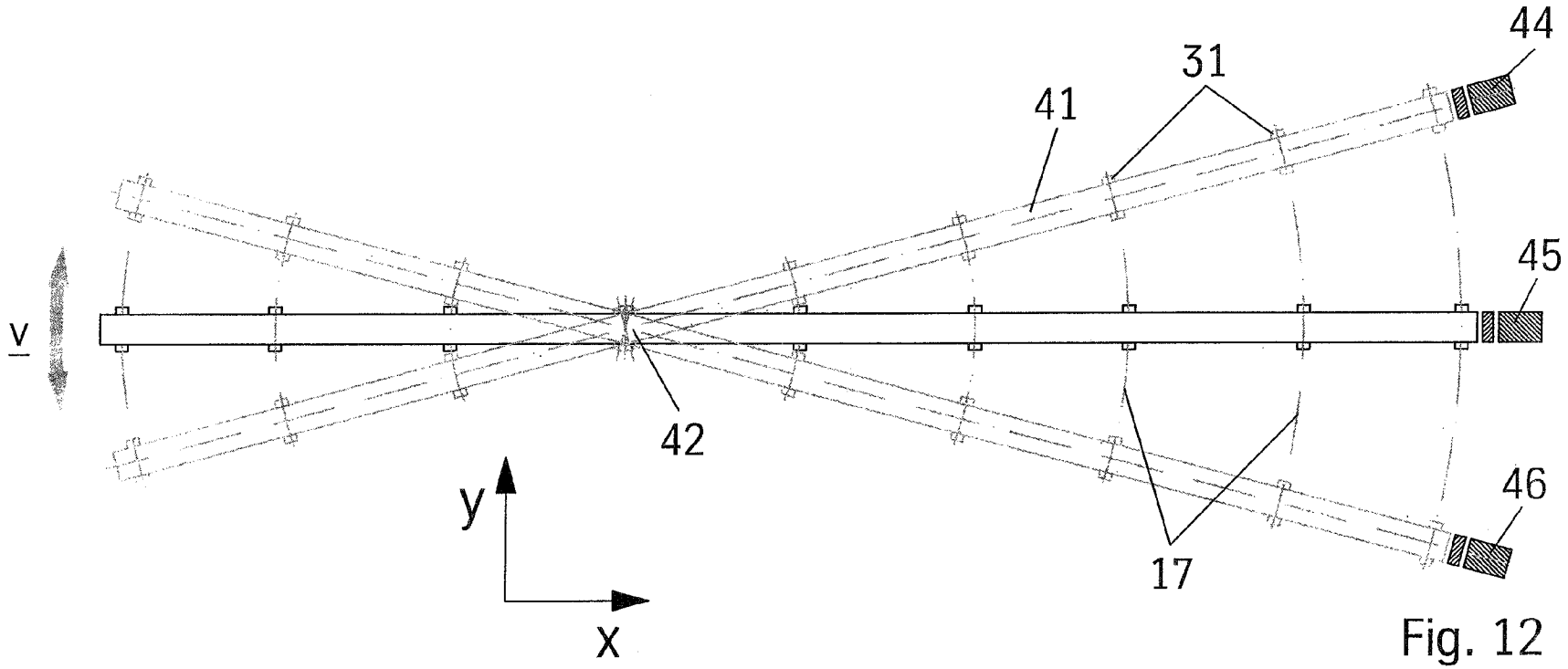
FIGS. 12 and 13 of FIG. 2 are top views of further exemplary embodiments of inventive lane-changing devices.

A further advantage of the present invention is that the design of support frame 31 described is also suitable for other types of line-changing devices. FIG. 12 shows, e.g., a line-changing device designed as a swivel platform. In this case, a rigid rail section 41 is provided, which is pivoted as a whole, i.e., without bending, as indicated by a double arrow v. To this end, rail section 41 is supported in a center section using a rocker pivot 42 such that it may pivot around a—typically—vertical axis (z-axis). As a result, it is possible to orient at least one end of rail section 41 in the direction of one of, e.g., three routes 44, 45 and 46. This may be desirable for a magnetically levitated train, e.g., at terminal stations, in order to allow a vehicle arriving on route 45 to leave via another route 46 or 44 for the return trip, by moving the vehicle onto rail section 41 and pivoting it—and the vehicle—around rocker pivot 42.

The design of the line-changing device shown in FIG. 12 essentially corresponds to that shown in FIGS. 2 through 11. The only difference from bending points, however, is that the various support frames 31—which are only shown schematically—move on rails 17, which are also shown schematically and extend exactly along circular arcs. Since their radii—measured from rocker pivot 42 outward—are different, however, the relative positions of wheels 16 in particular wheel modules 31*b*, 31*c* must also differ. As in the case illustrated in FIG. 10, this is brought about, according to the present invention, by selecting different inclination angles α of top plates 32*a*, 32*b* accordingly. It is not necessary to change wheel modules 31*b*, 31*c* or the parts subject to wear included in them.

Figure 13:
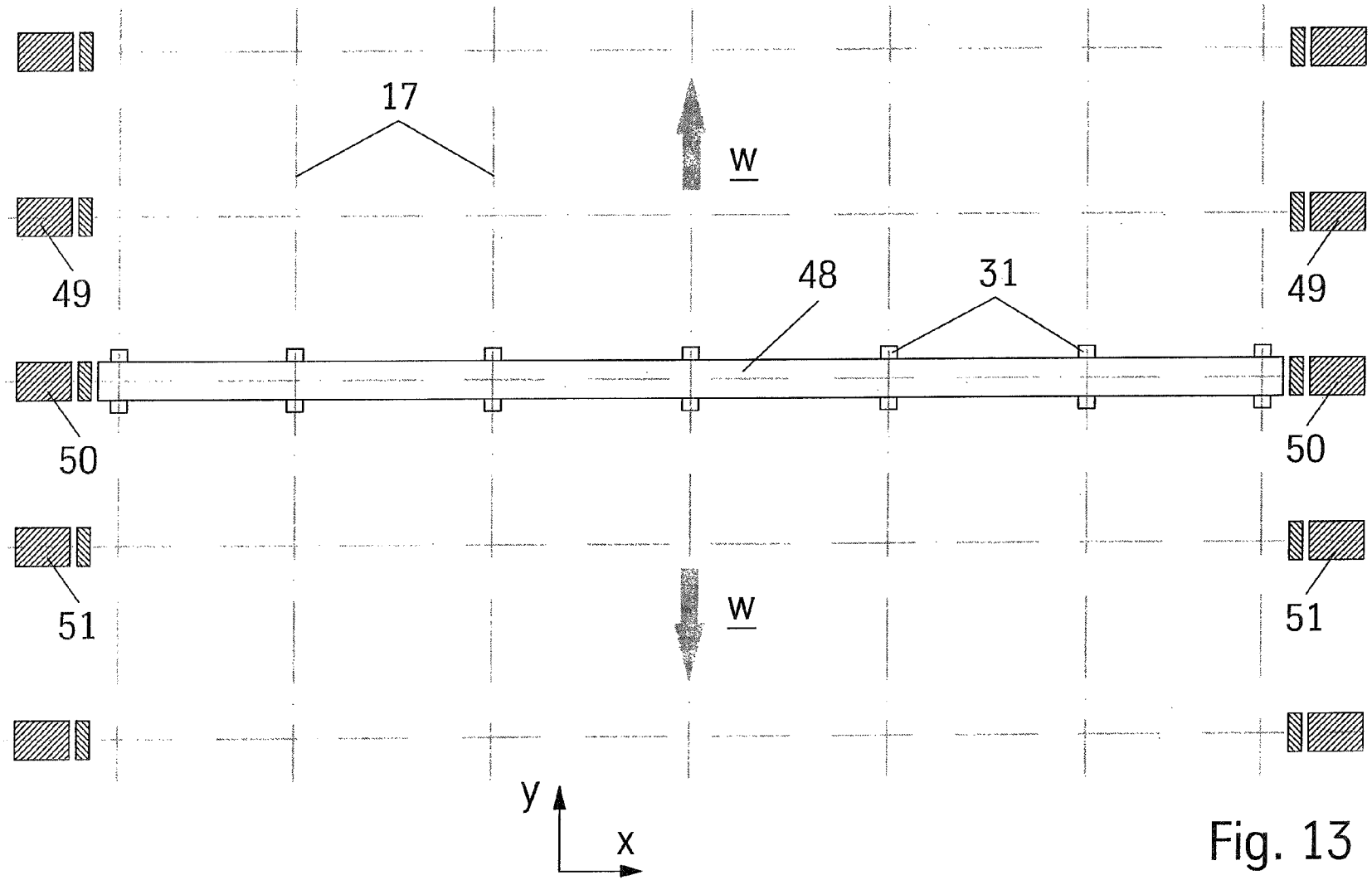

FIG. 13 is a schematic illustration of a line-changing device designed as a transfer table. In this case, a rigid rail section 48 is displaced in entirety—that is, without bending—e.g., parallel to a straight line and, e.g., in the y-direction, as indicated by a double arrow w. This makes it possible to align rail section 48 with one of several routes 49-49, 50-50, 51-51, etc. This may be carried out either with or without a vehicle on rail section 48. The same wheel modules 31*b*, 31*c* described above may also be used with this variant. Since this is a parallel displacement along straight rails 17, which are shown only as lines, all support modules 31*a* may have the identical design in this case as well. To this end, top plates 32*a*, 32*b* are positioned, e.g., fully parallel, thereby forming an inclination angle α=0. The rotation axes of all wheels 16 of all support frames 31 involved are therefore automatically located in parallel with each other.

Figure 14:
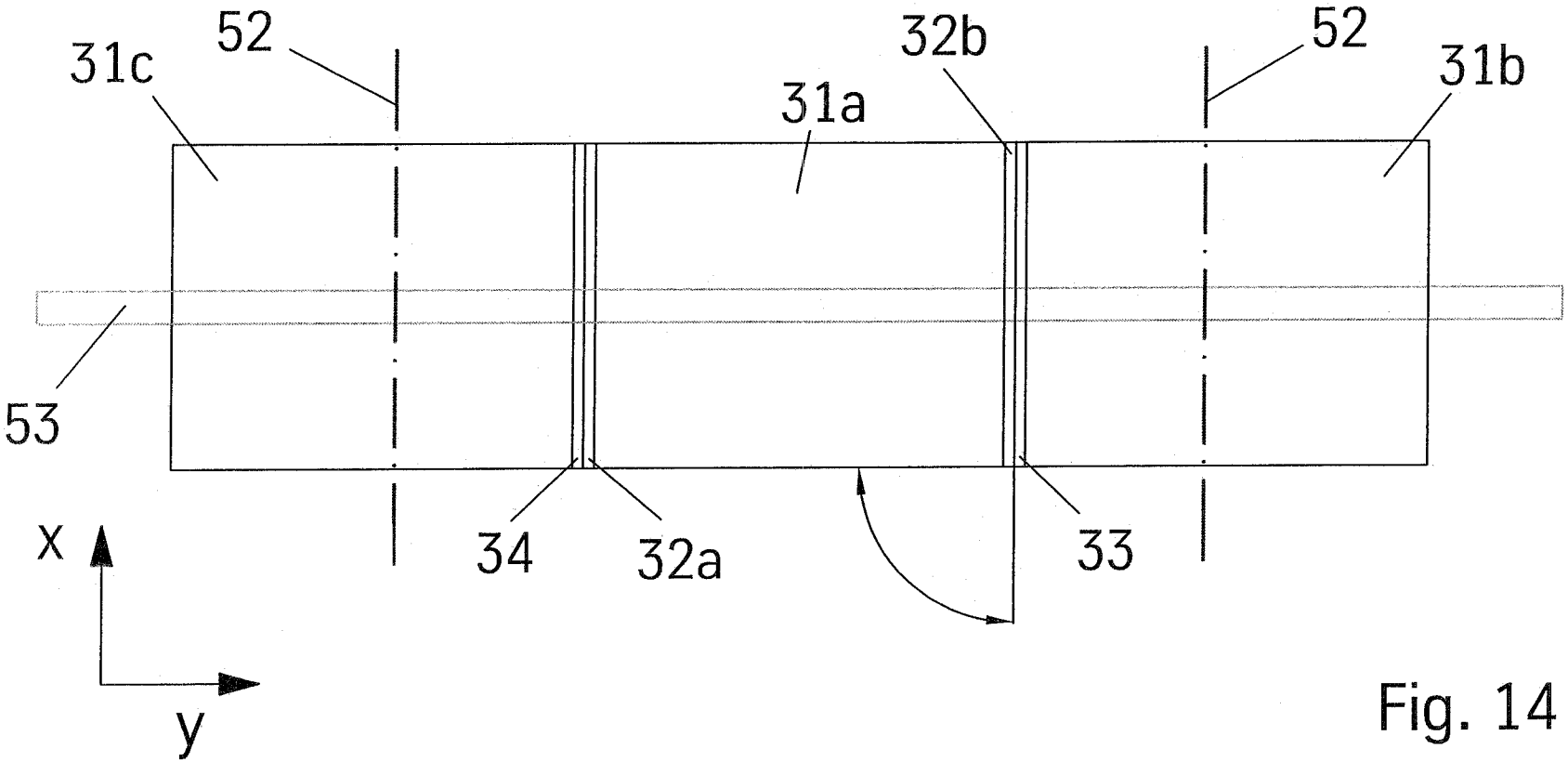
FIGS. 14 and 15 are schematic exemplary embodiments of the design of an inventive support frame.

In all, the present invention provides that all wheel modules 31*b*, 31*c* are nearly identical in design, but that the rotation axes of their wheels 16 are adapted to different rails (FIGS. 10, 12, 13) via the selection of inclination angle α of top plates 32*a*, 32*b* of assigned support module 31*a*. This is depicted roughly schematically in FIGS. 14 and 15; wheel modules 31*b*, 31*c* are shown as squares, and mounted on them are two support modules 31*a*, 31*d*, which are shown as squares or trapezoids. The rotation axes of not-shown wheels 16 are shown as dashed lines 52. In the exemplary embodiment, rotation axes 52 extend parallel with assembly plates 33, 34 and perpendicularly to the upper edges of wheel modules 31*b* through 31*c*. The upper or lower edges, for instance, of support modules 31*a*, 31*d* are used as the reference lines and planes for the position of top plates 32*a*, 32*b* and assembly plates 33, 34.

Figure 15:
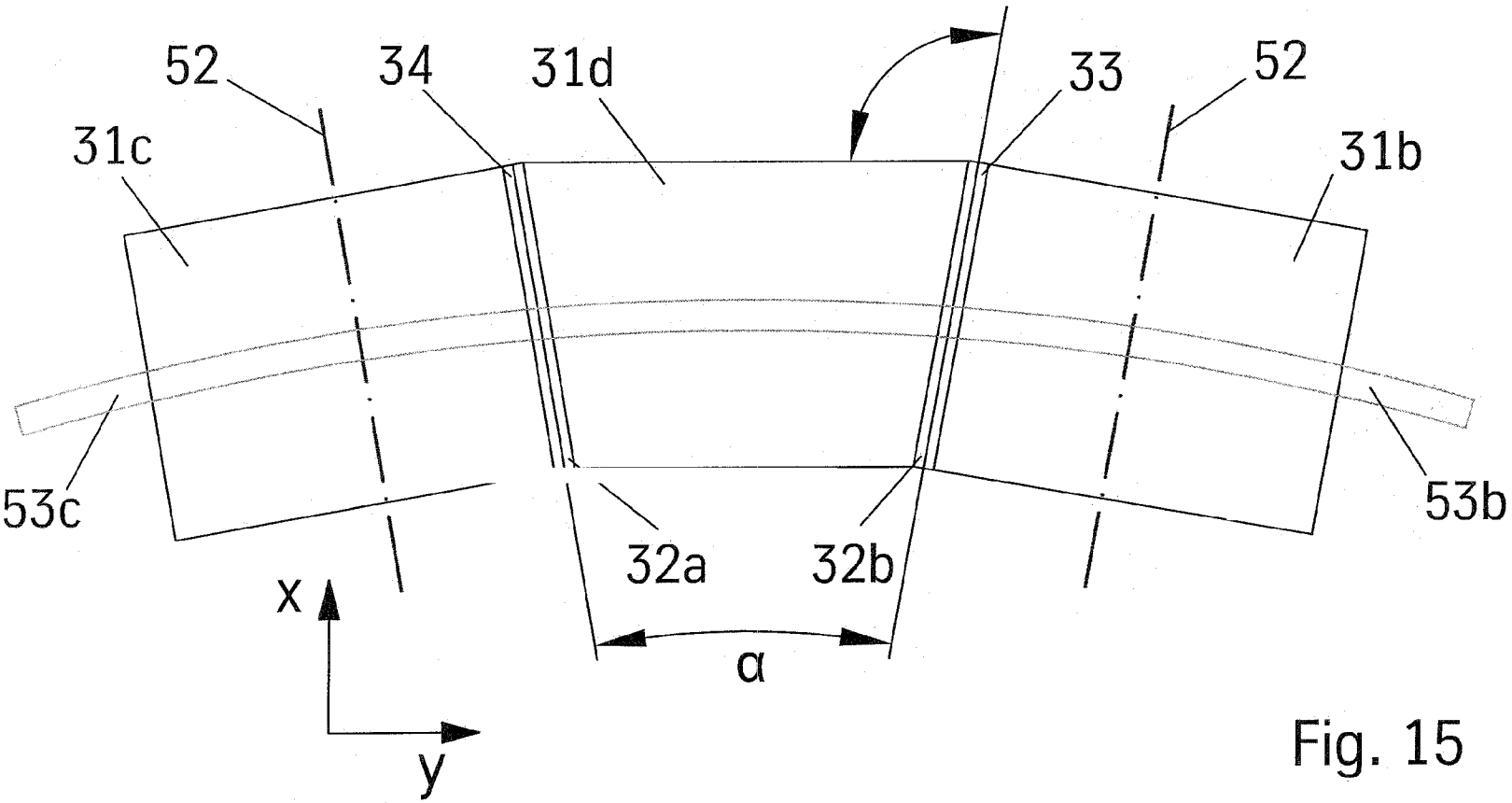

Accordingly, for one line-changing device as shown in FIG. 13, all plates 32*a*, 32*b*, 33 and 34, which are assumed to be plane-parallel in this case, and rotation axes 52 are parallel with each other and perpendicular to a straight rail section 53, which represents rails 17. The wheels of both modules 31*b*, 31*c* therefore roll along a straight line, as in the case illustrated in FIG. 13. In contrast, FIG. 15 shows that top plates 32*a*, 32*b* now form an inclination angle a≠0 and, with the upper edge of trapezoidal support module 31*d*, form an angle that is not 90°. If the same wheel modules 31*b*, 31*c* are used as in FIG. 14, their wheels roll on rail sections 53*b*, 53*c*—shown schematically—which are curved, e.g., as in FIGS. 10 and 12.

The present invention is not limited to the exemplary embodiment described, which could be modified in various manners. This applies in particular for the design described with reference to FIG. 8. As an alternative, it would be possible, e.g., to provide entirely different drive mechanisms 18 (refer, e.g., to DE 37 09 619 C2). As a result, nothing about the position of wheel modules 31*b*, 31*c* relative to support modules 31*a* and the course of rails 17 would change. Furthermore, it is clear that wheel modules 31*b*, 31*c* may be designed with or without drive mechanism 18, and a drive mechanism 18 may be assigned to only one of the two wheels 16 of support frame 31, or only selected support frames 31 may be provided with at least one drive mechanism 18 each along rail sections 1, 41, 48.

With the exemplary embodiment described, complete drive mechanism 18 is also accommodated in particular wheel module 31*b*, 31*c*. It may also be advantageous to ensure the motion of rail sections 1, 41, 48 in a defined plane by installing a guide rail 54 (FIG. 8) underneath holding plate 24, on the underside—which represents the defined plane—of which a pressure roller 55 mounted on drive shaft 19 rolls. It is also clear that the orientation of the positions of wheels 16 and wheel axes 52 relative to each other as described in FIGS. 10, 14 and 15 serve only as examples, and that any other orientation is possible. In addition, the present invention is intended to include not only the complete line-changing devices themselves, but also kits that contain all of the components required to manufacture a support frame 31 or different support frames 31, and the wheel modules 31*b* and 31*c*—which are therefore preferably identical—contain support modules 31*a* with differently positioned top plates 32*a*, 32*b*.

Furthermore, damping elements, which are known per se, may be provided between rail sections 1, 41, 48 and support modules 31*a*, and twin wheels located next to each other or in tandem may be provided in each wheel module 31*b*, 31*c*, or only in selected wheel modules 31*b*, 31*c*. Finally, it is understood that the features described may also be used in combinations other than those described and depicted.

It will be understood that each of the elements described above, or two or more together, may also find a useful application in other types of constructions differing from the type described above.

While the invention has been illustrated and described as embodied in a line-changing device for magnet levitation trains and kit for its manufacture, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A line-changing device for a magnetic levitation trains, the device comprising a rail section;

at least one rail located transversely to said rail section;

a support frame for said rail section , including at least two wheels supported on said rail and a support module connected with said rail section, and two wheel modules each provided with a respective drive mechanism, attached to sides of said support module in replaceable manner, and each rotatably supporting at least one of said wheels.

2. A line-changing device as defined in claim 1, wherein the line-changing device is configured as a transfer table.

3. A line-changing device as defined in claim 2, wherein said rail section rests on a plurality of such support frames positioned at intervals along said rail section, the wheels of which are supported on said rail which extend in parallel with each other.

4. A line-changing device as defined in claim 1, wherein the line-changing device is configured as a swivel table.

5. A line-changing device as defined in claim 4, wherein said rail section is supported with a rocker pivot such that it is rotatable about a rotation axis located perpendicularly to said rail section, and it rests on a plurality of such support frames positioned at intervals along said rail section, the wheels of which are supported on the rails that are curved along circular trajectories having different radii relative to said rocker pivot.

6. A line-changing device as defined in claim 1, wherein said line-changing device is configured as a bending point, and said rail section is configured as a bending mount.

7. A line-changing device as defined in claim 6, wherein said rail section rests on a plurality of such support frames positioned at intervals along said rail section, the wheels of which are supported on said rails that are curved along trajectories that result from a bending curve of said rail section when said bending point is actuated.

8. A line-changing device as defined in claim 1, wherein parts of the line-changing device subject to wear are accommodated in said wheel modules, and said support modules have no drive parts that are subject to wear.

9. A line changing device for a magnetic levitation train, the device comprising a rail section;

at least one rail located transversely to said rail section;

a support frame for said rail section including at least two wheels supported on said rail and a support module connected with said rail section, two wheel modules attached to sides of said support module in replaceable manner and each rotatably supporting at least one of said wheels, and a drive mechanism in each of said wheel modules, including a motor and a gear, and each being detachable from said support module in a single step.

10. A line-changing device for a magnetic levitation trains comprising a rail section; at least one rail located transversely to said rail section; a support frame for said rail section which includes at least two wheels supported on said rail said support frame including a support module connected with said rail section, and two wheel modules attached to sides of said support module in replaceable manner, in each of which at least one of said wheels is rotatably supported wherein at least one of said wheel modules is provided with a drive mechanism, wherein said support module includes two lateral top plates, and said wheel modules each include an assembly plate configured to be attached to one of said top plates.

11. A line-changing device as defined in claim 10, wherein said top plates and said assembly plates are provided with interacting positioning means.

12. A line-changing device as defined in claim 10, wherein said top plates are positioned in parallel with each other and perpendicularly to said at least one rail.

13. A line-changing device as defined in claim 10, wherein said wheels have rotation axes that are parallel to said assembly plates.

14. A line-changing device as defined in claim 10, wherein said wheel modules are configured substantially identically, and said wheel modules are adapted to the rails assigned to them by selecting an inclination angle of said top plates of the associated support module.

15. A line changing device as defined in claim 10, comprising a plurality of said wheel modules and support modules, wherein said top plates are positioned at adjustable inclination.

16. A line-changing device for magnetic levitation trains, comprising a rail section; at least one rail located transversely to said rail section; a support frame for said rail section, which includes at least two wheels supported on said rail, said support frame including a support module connected with said rail section, and two wheel modules attached to sides of said support module in replaceable manner, in each of which at last one of said wheels is rotatably supported, wherein at least one of said wheel modules is provided with a drive mechanism, wherein said drive mechanism includes a motor and a gear, and said at least one wheel module including said drive mechanism with said motor and said gear is detachable from said support module in a single step, wherein said wheel modules are attached to said support module and detachable from said support module in planes extending perpendicularly to said at least one rail.

* * * * *